US005944961A

United States Patent [19]

Gandman

[11] Patent Number: 5,944,961

[45] Date of Patent: Aug. 31, 1999

[54] INJECTING LIQUID SOLUTION INTO A THERMAL CRACKING GASEOUS PROCESS STREAM

[76] Inventor: Zalman Gandman, 46, Woodcutters La. Staten Island, New York, N.Y. 10306

[21] Appl. No.: 09/027,943

[22] Filed: Feb. 23, 1998

[51] Int. Cl.[6] ..... C10G 9/12; C10B 43/08

[52] U.S. Cl. ..... 202/241; 196/122; 196/127; 208/48 R; 585/922; 585/950

[58] Field of Search ..... 202/241; 196/122, 196/127; 208/48 R, 48 AA; 585/648, 922, 950

[56] References Cited

U.S. PATENT DOCUMENTS

| | | | |
|---|---|---|---|
| 2,893,941 | 7/1959 | Kohfeldt | 208/48 |
| 3,617,478 | 11/1971 | King et al. . | |
| 4,410,418 | 10/1983 | Kukes et al. | 208/48 R |
| 4,542,253 | 9/1985 | Kaplan | 585/650 |
| 4,708,787 | 11/1987 | Peters et al. | 208/130 |
| 4,889,614 | 12/1989 | Forester | 208/48 AA |
| 5,284,994 | 2/1994 | Brown et al. | 585/648 |
| 5,358,626 | 10/1994 | Gandman | 208/48 AA |
| 5,435,904 | 7/1995 | Reed et al. | 208/48 AA |
| 5,565,087 | 10/1996 | Brown et al. | 208/48 R |

FOREIGN PATENT DOCUMENTS 1578896 11/1980 United Kingdom .

OTHER PUBLICATIONS

"Liquid–in–Gas Dispersions"; pp. 18–61, McGraw–Hill, New York 1973.

*Primary Examiner*—Bekir L. Yildirim
*Attorney, Agent, or Firm*—Robert W. J. Usher

[57] ABSTRACT

Apparatus for injecting antifoulant solution into a hot gaseous process stream in a thermal cracking furnace tube to inhibit coke deposition includes an inner antifoulant supply tube having one end connected to a pressurized supply of antifoulant solution and an access port along the furnace tube and the other end connected to an inlet of a centrifugal, atomizing nozzle having an outlet for discharging the antifoulant solution as a spray of small drops. An outer tube extends in concentric, insulating relation along the antifoulant supply tube between the access port and the nozzle, A flow deflector has an apertured peripheral wall with a portion defining a tubular mixing and vaporizing chamber extends coaxially along the furnace tube and an axial inlet end mounted in registration with the nozzle outlet to receive all spray therefrom. An axial outlet end is radially enlarged so as to deflect the gaseous process stream through wall apertures into the chamber. All drops of antifoulant solution are vaporized and dispersed within the chamber without the antifoulant solution contacting the furnace tube wall so that only particulate antifoulant is entrained in the gas process stream. The chamber is conical or cylindrical and the wall portion is formed with lateral apertures for admitting deflected gas stream into the chamber. The conical shape can be formed by a series of axially displaced, coaxial, hollow cylindrical portions of progressively increasing diameter.

19 Claims, 7 Drawing Sheets

FIG. 2b
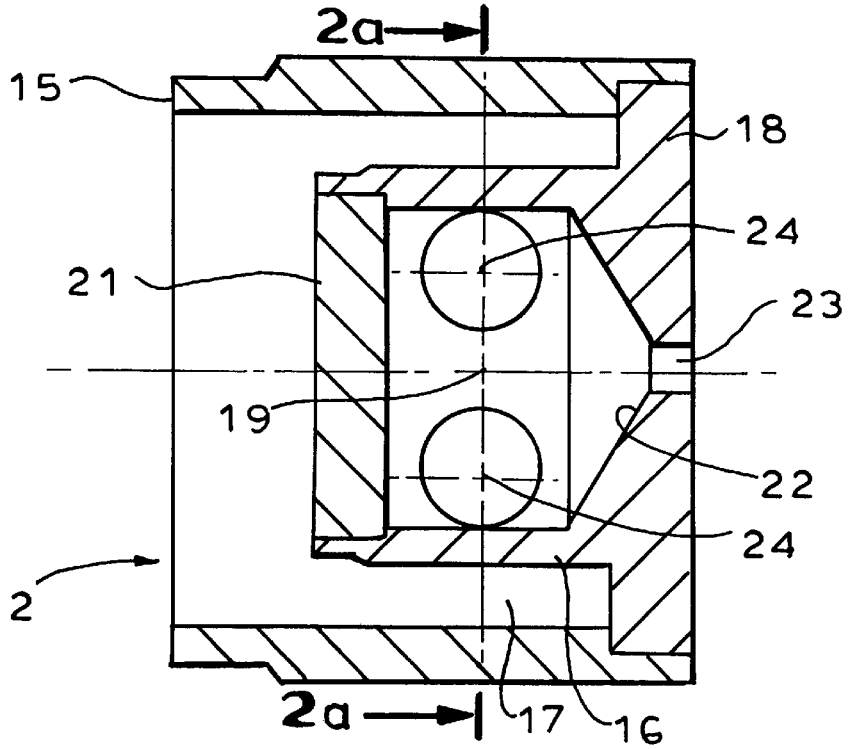
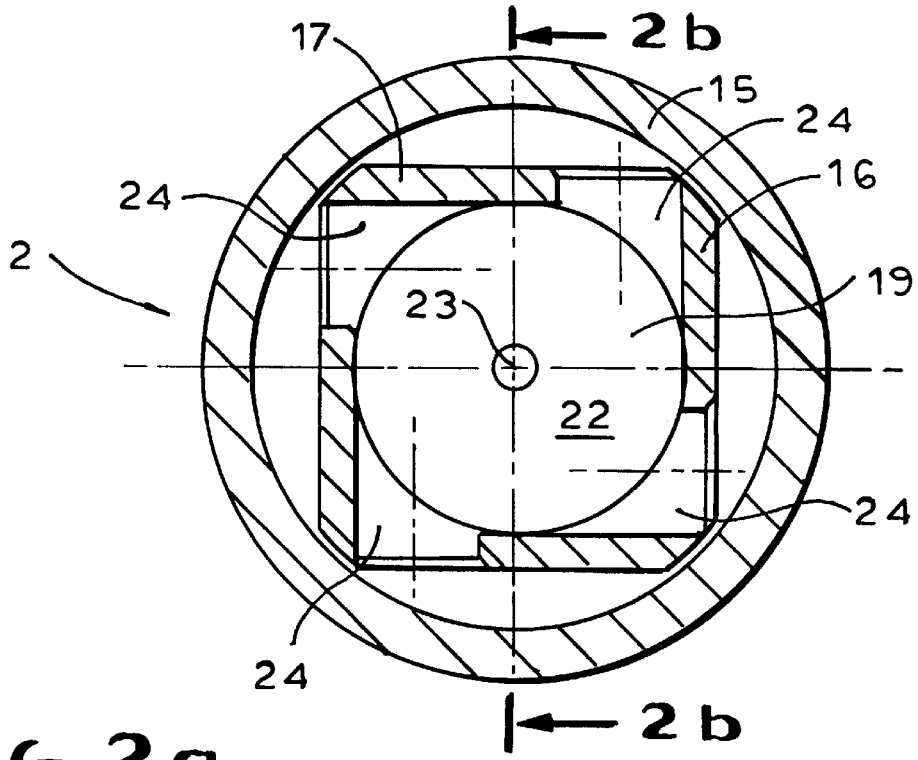
FIG. 2a

FIG. 7
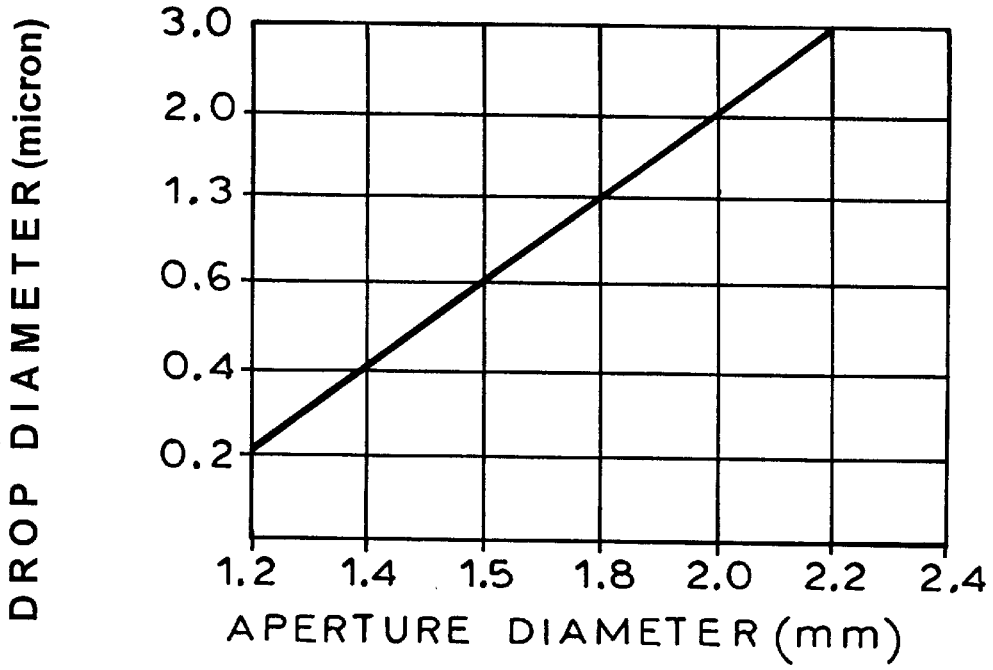
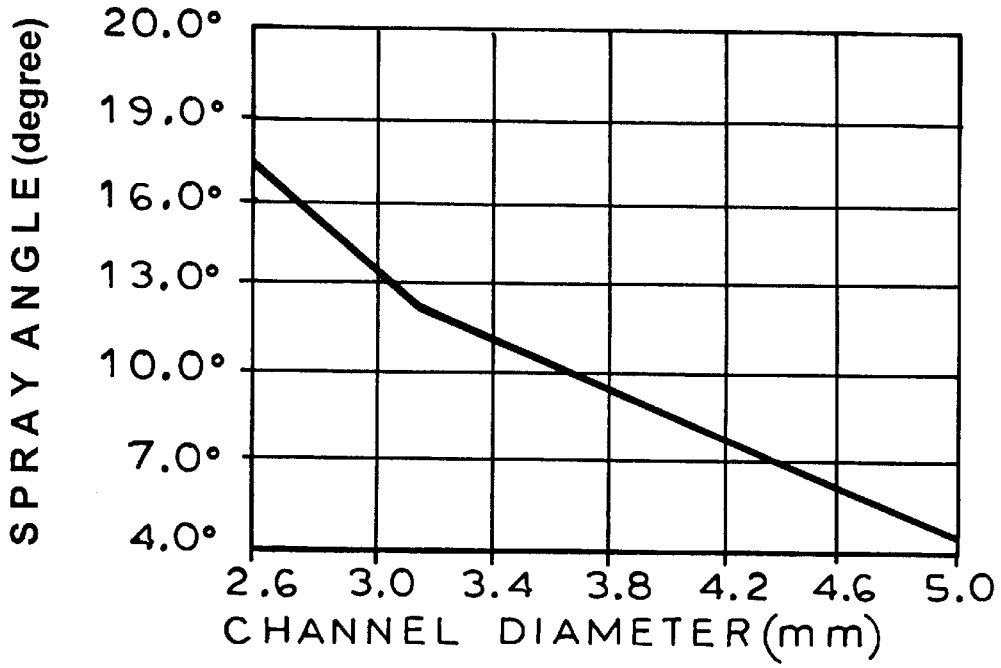
FIG. 8

INJECTING LIQUID SOLUTION INTO A THERMAL CRACKING GASEOUS PROCESS STREAM

FIELD OF INVENTION

The present invention relates to the injection of a liquid solution into a gaseous process stream of a cracking furnace so as to reduce undesirable coke formation and carbon oxides, to remove coke deposit and to provide the catalytic thermal cracking of hydrocarbons.

BACKGROUND OF THE INVENTION

The cracking furnace forms the heart of many chemical manufacturing processes. Often, the performance of the cracking furnace largely determines profitability and it is therefore extremely desirable to maximize such performance.

In manufacturing processes such as the production of ethylene, feed hydrocarbon gas such as ethane, propane, butane and/or naphtha, gas oil is fed into the cracking furnace. A diluent such as steam is usually combined with the feed hydrocarbon forming a gaseous feed or gaseous process stream which is converted in the furnace, to a gaseous mixture, which primarily contains hydrogen, methane, ethylene, propylene, butadiene and other by-products. At the furnace exit, this mixture is cooled, enabling removal of most of the heavier products, and compressed.

The compressed mixture is routed through various distillation columns where the individual components, mostly ethylene and propylene, are purified and separated and removed from the ethylene plant to be used in variety of secondary products.

The primary function of the cracking furnace is to convert the feed stream to ethylene and/or propylene. As well known, a semi-pure carbon, which is termed "coke", is formed on the metal surfaces of the cracking tubes/coils which are in contact with the feed stream and on the metal surfaces of the heat exchangers which are in contact with the gaseous effluent and product mixture from the cracking furnace, as a result of the furnace cracking operation. Coke formation generally results from a combination of a homogeneous thermal reaction in the gas phase and a heterogeneous catalytic reaction between the hydrocarbon in the gas phase and the metal in the walls of the cracking tubes or heat exchangers (catalytic coking).

In addition to the above, well recognized, locations of coke deposit, coke might form on connecting conduits and other metal surfaces, which are exposed to hydrocarbons at the high temperatures. A more subtle effect of coke formation occurs when coke enters the furnace tube alloy in the form of a solid solution. The carbon then reacts with the chromium in the alloy and chromium carbide precipitates. This phenomenon, known as carburization, causes the alloy to lose its original oxidation resistance, thereby becoming susceptible to chemical attack. The mechanical properties of the tube are also adversely affected. Carburization may also occur in respect of iron and nickel in the alloys.

A number of heat-resistant alloys have been proposed for improving high-temperature strength, corrosion-resistance and heat-resistance. However, as no such alloys suppress coke deposition by promoting a water-gas reaction in the cracking furnace, conventionally, a large amount of steam has been added to the hydrocarbons being cracked, thereby suppressing coke deposition to a certain degree. However, the degree of suppression is still not sufficient to prevent coke deposition.

A common operating procedure for a cracking furnace is to periodically shut down the furnace in order to burn out the deposits of coke. This downtime results in a substantial loss of production. In addition, coke is an excellent thermal insulator. Thus, as coke is deposited, higher furnace temperatures are required to maintain the gas temperature in the cracking zone at a desired level. Such higher temperatures increase fuel consumption and will eventually result in shorter tube life.

The period during which thermal cracking of hydrocarbons can be continued without decoking is usually from 10 to 60 days, depending on the hydrocarbon feed quality and the severity of the pyrolysis conditions. Approximately, one to three days are required for decoking, resulting in a decrease in the amount of ethylene, propylene etc. produced. In addition, when decoking not only must an enormous amount of steam be used but an amount of fuel sufficient to heat the thermal cracking coil is required.

There have been numerous attempts over very many years to suppress coke deposition, thereby making long-term, continuous thermal cracking of hydrocarbons possible, for example, by incorporating sulfide, sulfate or thiosulfate of alkali metals or alkaline earth metals into the hydrocarbon feed, as inhibitors; precoating or plating the tubes with noble or other metal alloy; applying a protective film of halogen containing silanes, disilanes and siloxanes, and converting the silicon compound to silicon dioxide; and applying a protective film of a metal-ceramic material containing aluminum oxide dispersed in chromium. on the inner walls of furnace tubes.

U.S. Pat. Nos. 2,893,941; 3,617,478; 4,542,253; 4,410,414; 4,889,614; 5,358,626; 5,435,904; 5,565,087 and UK 1,578,896 are examples of some of many prior proposals utilising antifoulant solution, by injection, in the main, into the cracking coils and, in so far as they may be relevent, the disclosures of the above patents are incorporated herein by reference.

In particular, U.S. Pat. No 5,435,904 teaches the injection of a liquid tin-containing antifoulant into a saturated hydrocarbon feed stream for a thermal cracking reactor so as to alleviate the undesirable formation of coke and carbon monoxide during subsequent thermal cracking of light hydrocarbons. However, although the time of the run is increased, coke deposits still accumulate on the inner walls of the cracking tubes requiring periodic shutdown to remove the coke deposits.

None of the approaches taught by the prior art which teach injection of antifoulant solutions to suppress the catalytically carbonizing action of nickel and iron of heat-resistant alloys, has been entirely satisfactory particularly as the prior apparatus for injecting the solution into the gaseous stream have not been effective in providing cover of the antifoulant over the entire inner surfaces of the furnace tube.

Accordingly, a process which could effectively decoke coils or tubes within a thermal cracking furnace without having to raise the wall temperatures within coils to perform a decoking process and without having to shut down the furnace, would be highly desirable.

As generally known, a solution may be dispersed into a process gas stream in several conditions. However, a disadvantage arises when the solution is injected as a continuous stream as the solution may reside on a support surface as a statistical film, only one side of which contacts the process gas stream. Subsequent evaporation of the liquid, leaves solid residues (additives or solute) deposited on the support surface so that a substantial part of these additives is inactive. Furthermore, the deposition of the solution and subsequent evaporation may result in damage to the furnace tube.

However, dispersal of a solution into small drops, which can be dynamically supported in any suspended conditions enables soluble additives to be distributed into any coil such they will be covering all inner surface of a coil. When liquid is disintegrated to drops the interphase surface is increased. For so example, the disintegration of a drop with a diameter of about 1.0 millimeter into droplets with diameters of about 1 micron increases the interphase surface one thousandfold, from 0.0314 to 31.4 square centimeters.

Drops can disintegrate to very small sizes by interaction with a process gas stream. To obtain drop instability, for example, for a water drop with diameter about 1 mm in a process gas stream, the stream velocity should be about 15 meter/sec. To obtain a reduction of drop diameter to about 100 micron, the velocity must be increased about threefold (3.3).

Reference is made to the section on drop formation in Chemical Engineer's Handbook edited by John Perry and published by McGraw-Hill Book Company in 1963, the disclosure of which is incorporated herein by reference.

The process gas density, viscosity, and surface tension, and the density of the liquid all affect the resulting drop size. Increasing the process gas density decreased the drop stability, resulting in smaller drops. Increasing liquid viscosity and surface tension are increased increases drop size.

The process of drop decomposition causes liquid to cross from high pressure zones to low pressure zones causing the liquid to evaporate very quickly. As a result of the large interface surfaces a spray of small drops is quickly vaporized.

SUMMARY OF THE INVENTION

It is an object of this invention to provide an apparatus for injecting a liquid solution into a gas flowing to and through a cracking furnace for thermally cracking hydrocarbon feed. It is another object of this invention to provide an apparatus for injecting a liquid solution into a feed gas flowing through a cracking furnace for thermally cracking any hydrocarbons, such as ethane, propane, butane, naphtha, kerosene, gas oil and the like, so as to reduce the undesirable formation of coke and carbon oxides, remove coke deposits from coils and provide catalytical pyrolysis of hydrocarbons.

According to the present invention, the apparatus comprises the combination of a centrifugal nozzle which atomizes a pressurized stream of liquid solution to form small drops and a mixing and vaporizing chamber into which the drops are discharged by the nozzle. The mixing and vaporizing chamber is defined by an apertured tubular flow deflector extending across the furnace tube so that the deflected gas stream passes through the apertures into the chamber dispersing and vaporizing the drops entirely within the chamber without contact of the solution with either the chamber or the surrounding furnace tube, thereby obviating a risk of furnace tube collapse by contact with a evaporating liquid solution. Thus, only dispersed particulate material is entrained in the hot gaseous process stream in the thermal cracking furnace tube gas stream for distribution throughout the remainder of the furnace tubes.

More particularly, the invention provides an apparatus for injecting a liquid solution into a hot gaseous process stream in a thermal cracking furnace tube for inhibiting the formation and deposition of coke, for removing coke deposits and for providing catalytic pyrolysis, so that the liquid solution does not contact the furnace tube/coil comprising:

(a) an inner liquid supply tube having one end for connection to a pressurized supply of antifoulant solution and another end extending through an access port along the furnace tube;

(b) a centrifugal, atomizing nozzle having an inlet mounted to another end of the supply tube, and a nozzle outlet for discharging the liquid solution as a spray of small drops;

(c) an outer tube extending in concentric, insulating relation along the liquid solution supply tube between the access port and the nozzle;

(d) a flow deflector comprising an apertured peripheral wall having a portion defining a tubular mixing and vaporizing chamber extending coaxially along the furnace tube and having an axial inlet end mounted in registration with the nozzle outlet to receive all spray therefrom and an axial outlet end which is radially enlarged so as to deflect the gaseous process stream through wall apertures into the chamber thereby dispersing and vaporizing all drops of liquid solution within the chamber without the liquid solution contacting the peripheral wall and the furnace tube so that only particulate material is entrained in the gas process stream leaving the outlet end for dispersal downstream throughout a radiation stage of the furnace.

Use of the apparatus results in a more effective inhibition of coke formation; suppression of carbon monoxide, removal of coke deposits and provides for catalytic pyrolysis of hydrocarbon feedstock.

BRIEF DESCRIPTION OF THE DRAWINGS

Specific embodiments of the invention will now be described by way of example only with reference to the accompanying drawings in which:

FIG. 2*a* is a transverse cross- sectional view of the centrifugal nozzle of the apparatus taken along line 2*a*—2*a* of FIG. 1;

FIG. 2*b* is an axial cross-sectional view of the nozzle taken along line 2*b*—2*b* of FIG. 2*a;*

FIG. 6*b* is a transverse cross-sectional view taken along line 6*b*—6*b* of FIG. 6*a* looking in a downstream direction;

FIG. 7 is a graph illustrating the dependence of drop diameter on nozzle outlet aperture diameter;

FIG. 8 is a graph illustrating the dependence of the angle subtended by the spray on nozzle input channel diameter.

DETAILED DESCRIPTION OF THE INVENTION

Figure 1A:
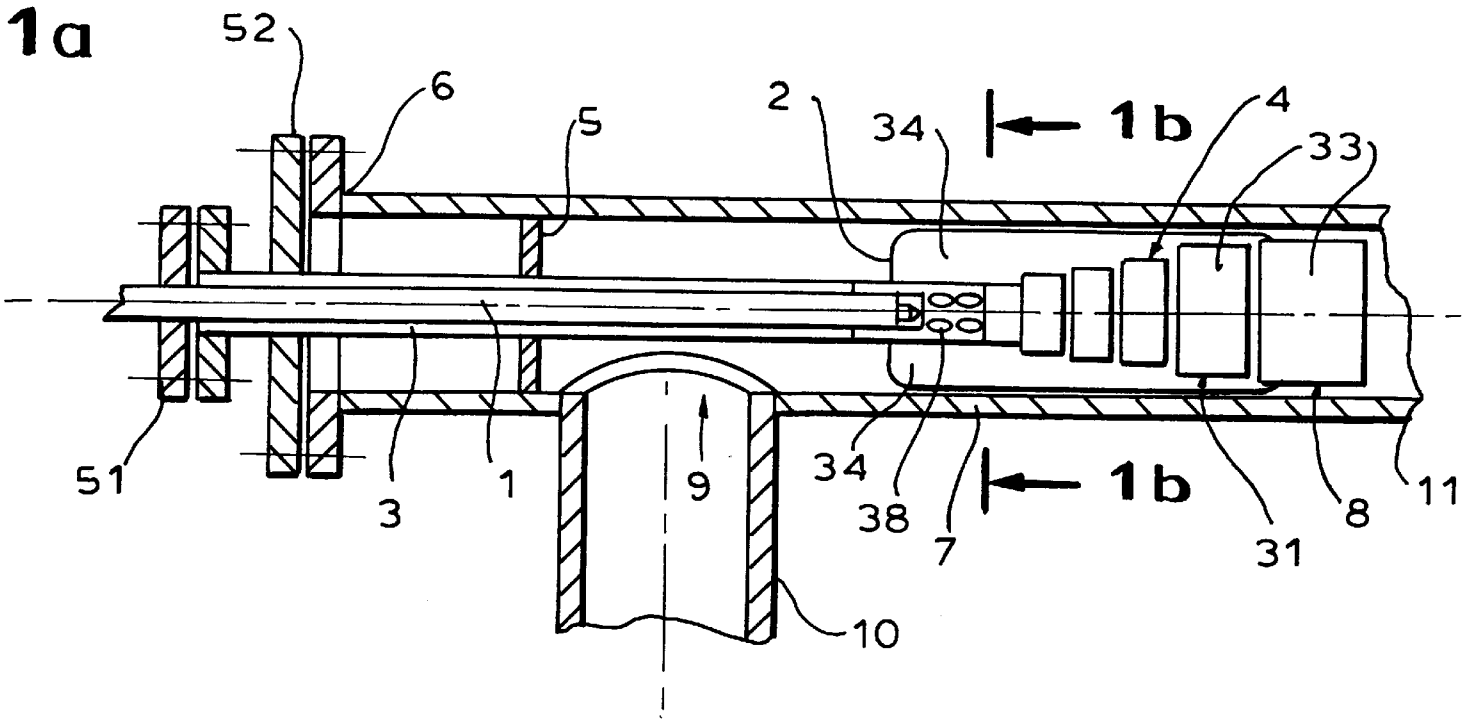
FIG. 1*a* is a diagrammatic view of a first embodiment of injection apparatus according to the invention.

Throughout the description like reference numerals will be used for similar elements while primed reference numbers will be used for corresponding parts.

Figure 1B:
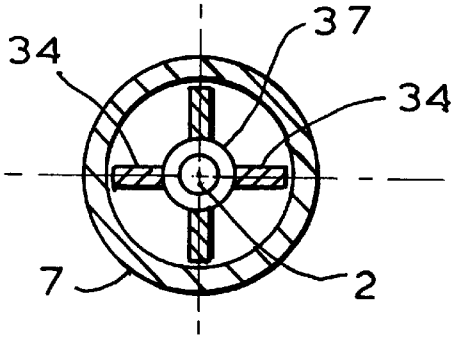
FIG. 1*b* is a transverse cross- sectional view taken along line 1*b*—1*b* of FIG. 1.

As shown in FIG. 1, in brief, the apparatus comprises a first, liquid solution conveying tube 1 terminated by a centrifugal atomizing nozzle 2 and concentrically mounted within a second, insulating tube 3 carrying, at a forward end, a conical gaseous flow deflector 4, operatively aligned with the nozzle 2, and a rearwardly spaced disc-form baffle 5. The subassembly is inserted through access port 6 concentrically into a coil or tube 7 at a location of a cracking furnace where the temperature is between about 300 and 650 degrees centigrade with the base 8 of the flow deflector 4 extending substantially entirely across the cracking tube diameter and the baffle 5 preventing substantial hot gas flow to the access port, so that a process gas 9 from a convection section 10 flows through the annular space between tubes 3 and 7 into the flow deflector 4, dispersing and completely vaporizing the atomized drops of liquid solution entirely within a zone within the deflector volume, thereby preventing contact of the drops with either the deflector or the cracking tube wall so that only small solid particles of active material are entrained dispersed in the process gas and proceed along coil 11 downstream into the radiation zone tube of the cracking furnace.

As shown in greater detail in FIG. 2*a* and FIG. 2*b*, the metal nozzle 2 comprises a hollow cylindrical outer casing 15 containing an inner spin chamber block 16 having a square section outer wall 17 extending rearwardly from a disk-shaped mounting flange 18 welded to the casing. The chamber block 16 is bored out to provide a central, axially extending, generally cylindrical spin chamber 19 with a frusto conical section 22 conveying a vortical stream of liquid from the spin chamber to an axial outlet orifice 23, and four, equi-spaced, tangential inlet channels 24 to the spin chamber.

A rear end of the wall receives a cap 21 welded thereon, closing the chamber rear. As the respective corners of the outer wall 17 are closely adjacent the outer casing, the incoming liquid solution is effectively split into four discrete streams for entering respective inlet channels.

The diameter of the nozzle orifice can be selected between about 0.2–2.2 mm. The drop sizes are about 0.2–40 microns, and the angle subtended by the spray is from about 5–30 degrees.

Other, centrifugal nozzles of the prior art which may, for example, have spiral flow guides may be substituted for that described above, for example, as described Chemical Engineer's Handbook edited by John Perry and published by McGraw-Hill Book company in various editions (e.g 1963 et seq.), the disclosure of which is incorporated herein by reference, particularly as illustrated on page 76 of the Russian translation of the edition published 1949.

In practice, the flow rate or throughput of liquid solution can be up to 300 liters per hour; the flow rate of said gas process stream through said conical flow deflector 4 is about 15–30 kg/meter square per second.

The mixing of the solution spray and process gas stream can be carried out at any suitable temperature and pressure conditions, preferably at about 300–650 C. and about 0.5–6 atmospheres.

The process gas stream may be (water) steam, or gaseous mixture of hydrocarbons and steam. Preferably, the hydrocarbons are ethane, propane, butane, naphtha, kerosene, gas oil or mixture thereof. Generally, the conical flow deflector is positioned at the located where the process gas stream is entering the reaction/radiant zone of the cracking furnace.

Figure 3:
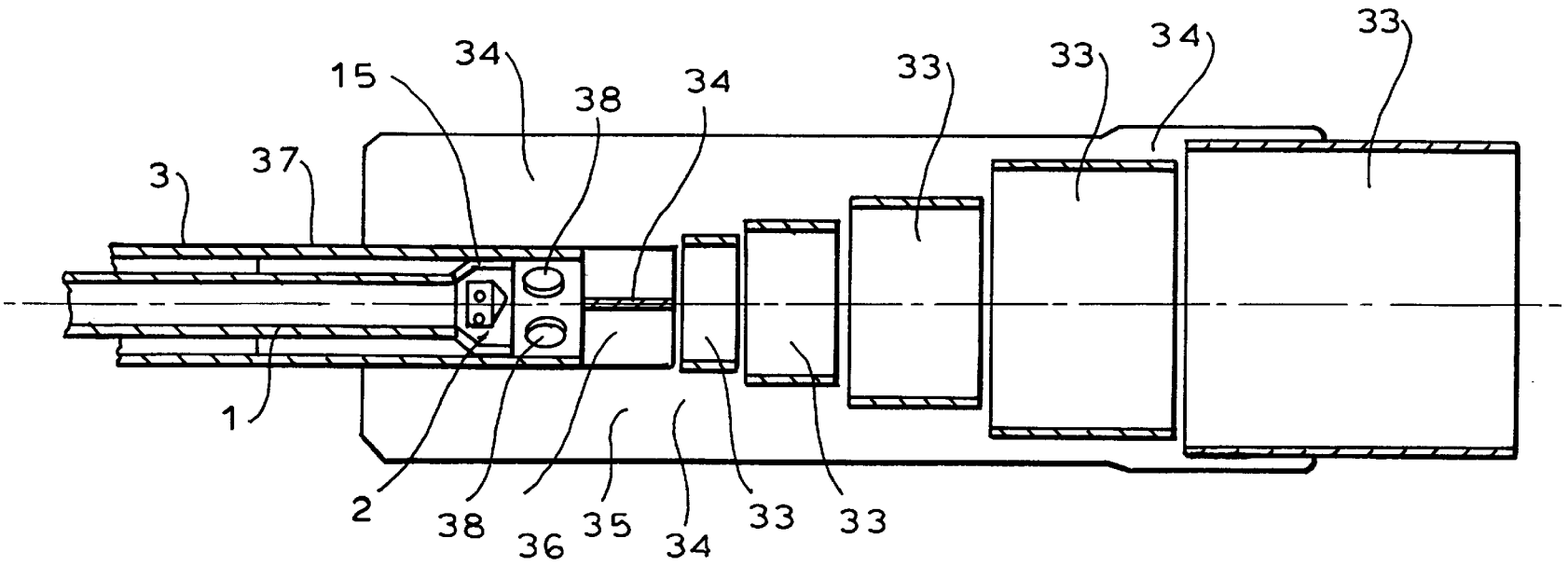
FIG. 3 is a schematic elevational view of flow deflector similar to that shown in FIG. 1 to an increased scale.

The flow deflector 4 shown in FIG. 1 and FIG. 3, comprises a conical portion 31 formed by a stepped wall portion comprising a series of open ended, hollow cylindrical portions 33 of progressively increasing diameters mounted together in axially displaced, coaxial relation by four axially extending, equiangularly displaced, radial fins 34. Rearward, inner end portions of the fins 35 bridge a small gap 36 and attach to a further tubular portion 37 coextensive with the tube 3 and which is formed with a series, (8 in FIG. 1, 4 in FIG. 3), of lateral, process gas admitting apertures 38 for admitting process gas transversely into a mixing and vaporization/drying zone within the deflector. Thus, the deflected process gas will enter the deflector both axially through the open ends of the cylindrical portions and transversely through the lateral apertures 38, gap 36 and small axial gaps between adjacent cylindrical portions which also form lateral apertures, providing a radially inwardly directed draught surrounding and converging on the spray jet for subtantially the entire length of the deflector thereby, confining the spray jet centrally of the tube ensuring that no drops contact the deflector wall.

As shown in FIG. 3, a portion of tube 3 adjacent the extension 37 receives the nozzle casing 15 concentrically as a close or sliding fit and the rear end portion of the nozzle casing wall is welded to the end of tube 1.

Figure 4A:
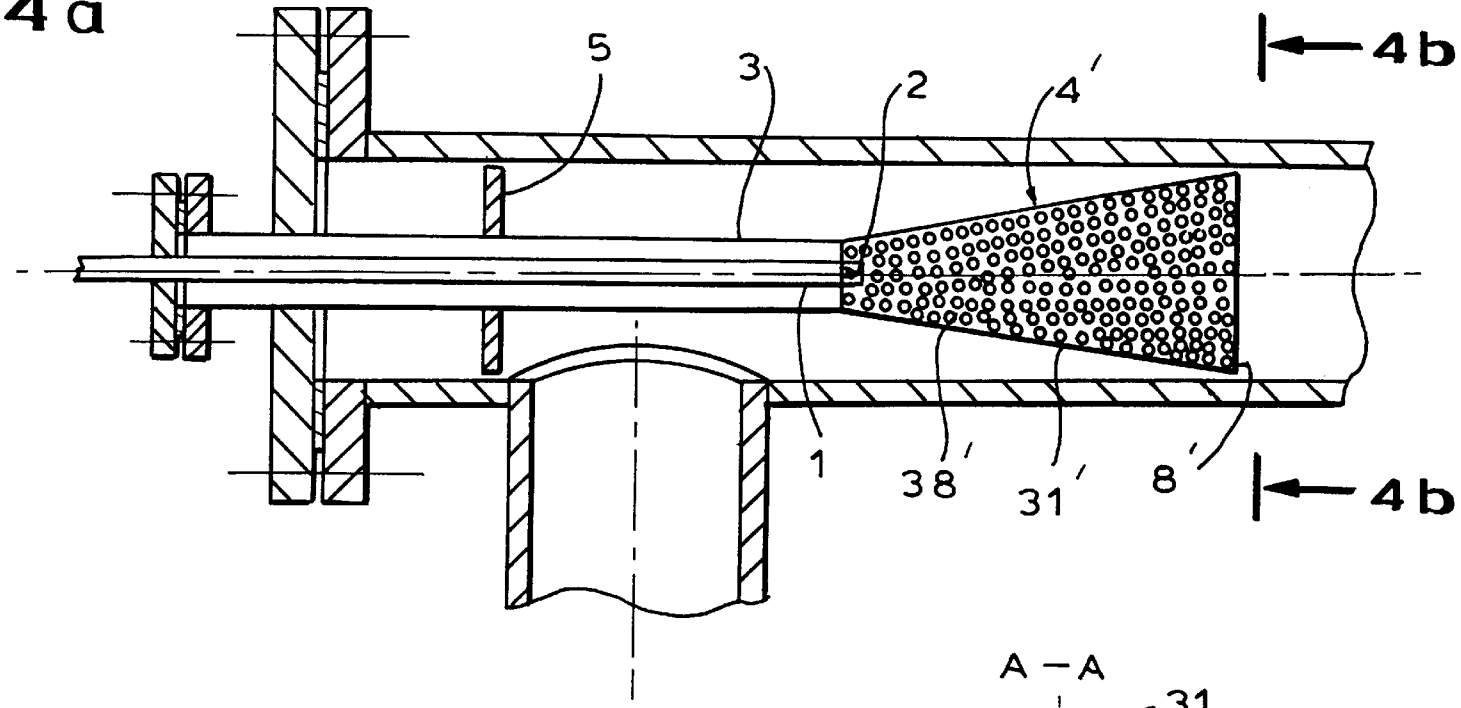
FIG. 4*a* is a diagrammatic view of a second embodiment of injection apparatus incorporating a different flow detector, tested in an industrial plant.
Figure 4B:
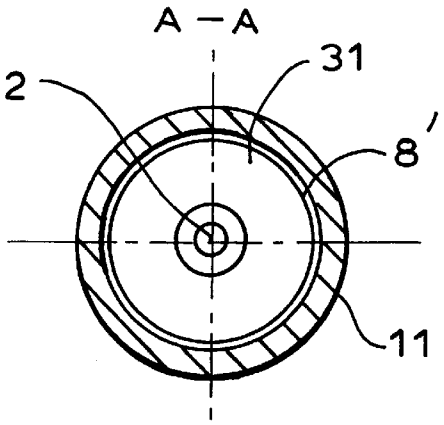
FIG. 4*b* is a transverse cross-sectional view taken along line 4*b*–4*a* of FIG. 1.

FIG. 4*a* and FIG. 4*b*, illustrate an embodiment for injecting an liquid solution into a thermal process cracking stream as tested in an industrial plant. Tube 1 (outer diameter about 25 millimeters) is fastened to nozzle 2. The flow deflector 4' has a continuously divergent conical wall 31' with a smaller end fastened by welding to the second tube 3 and a larger end 8' extending across substantially the entire diameter of the cracking tube. The wall 31' is perforated with lateral process gas admitting apertures 38'. The operating conditions are similar to those described above and, as above, the flow deflector defines a chamber with an internal mixing and vaporization zone which ensures that solution does not contact either the coil walls or the deflector wall.

In general, the process gas stream which passes through the apertures has both axial and transverse components (between 0 and 90 degrees to the axis of the flow deflector). The outer diameter of the open end or base of the deflector can be selected to be between about 2–50 mm less than the inner diameter of the furnace tube, which is usually between 60 and 250 mm. The axial length of the conical flow deflector length is can be selected to be between about 300–600 mm.

The inner diameter of the second tube 3 can be selected to be about 1.2–3.0 times larger than the outer diameter of said first tube 1 conveying the liquid solution and the second tube is attached to the casing of the nozzle 2, thereby forming the insulating annular space between said first tube and second tubes 1 and 2, respectively.

A solution injected into a furnace tube will experience the following operations:

atomizing of solution;

mixing drops with a process gas stream;

drying of drops

In these versions, the solution (e.g. water) can be applied to the nozzles at an absolute pressure of about 10–20 (and higher) atmospheres providing a pressure drop across the nozzle of 7–17 (and higher). This can atomize the solution to drops with diameters of about 0.2–3.0 microns. As a result of the large total surface area of the drops, the practical time is very small (less than 0.0004 seconds). This time determines the length of the conical flow deflector as the drops should evaporate completely before exit. Liquid solution properties, such as density, viscosity etc. are given in the Chemical Engineer's Handbook by John Perry, referred to above.

In the conical flow deflector the mixing of drops with the process gas stream is carried out at temperatures of about 300–650 C. The conical deflector prevented contact between drops and the hot tube surfaces thereby preventing any damage to the furnace tubes. The conical flow deflector should be arranged so that substantially all process gas passes therethrough enabling the length to be minimized.

Evaporation of the liquid solution leaves solid additive particles in the form ifs of hollow balls of the same size as the liquid drops.

Calculation of the approximate heat transfer between the liquid drops and the process gas stream can be carried out by the method utilizing the volume heat transfer coefficient Kv given by the following formula:

$$Kv=140G/d \text{ (watt/m hr. C)},$$

Wherein G—the mass velocity of the process gas stream, kg./m second;

d—the furnace tube inside diameter (ID), m.;

In this case, the total heat which is transferred to a solution equals:

$$Q=Kv*V*\Delta tav., \text{ (watts)},$$

Wherein V—the volume of the conical flow deflector;

Δ tav.—the average of the difference between temperatures at inlet and outlet of the flow deflector.

The Qt can be calculated from the following equation:

$$Qt=Gs.Cp(T_2-T_1)+Gs.r+Gs.Cp(T_3-T_2), \text{ (watts)},$$

Wherein Gs—the flow rate of a solution, liters/hr;

Cp—the specific heat, watts/kg C;

$T_1$—the initial temperature of a liquid solution, C;

$T_2$—the water boiling temperature, C;

$T_3$—the final temperature of the mixture of a liquid solution and the process gas stream at the outlet of the flow deflector;

r—the evaporation heat , watts/kg.

Thus, evaporating and superheating 300 liters/hr of solution requires a conical flow deflector with a volume about 0.113 liters.

To calculate the nozzle characteristics, the following empirical formulas can be used:

The angle of the liquid spray at nozzle outlet:

a) Tg a/2=w/Uo, wherein w—the circuit velocity of a liquid solution into the spin chamber of the nozzle, m/sec.;

Uo—the linear velocity of liquid solution at outlet the nozzle, m/sec.

Maximum size of drops (the median diameter):

b) $Smax=K.8.\delta g/p\ U^2o$, (micrometers), wherein δ—surface tension, kg/meter; for water δ=0.00745 kg/m c;

g—9.81 meter/sec s;

p—liquid solution density, kg/m c;

K—coefficient, depended of the liquid solution quality; for water K=2.5

As a rule, the flow rate of the solution is about 100–300 liters/hr. If this rate increases, the length of the solution spray can be so long as to cause problems with tube breakage.

By using formulas (a) and (b) described above, any nozzle data can be derived. However, because the formulae are empirical, it is necessary to test the actual performance of any selected design before use.

FIG. 7 illustrates dependence of drop diameter on nozzle orifice diameter. The input channel diameter d of the nozzle is 4.0 mm and the number of channels is 4.

FIG. 8 illustrates the dependence of the spray angle on input channel diameter (4 channels). The diameter of the nozzle orifice is about 2 mm.

As demonstrated by FIG. 7 and 8, increasing outlet hole diameter will increase drop size and increasing input channel diameter will decrease spray angle. By considering both formulae, the optimum data can be selected.

Figure 5A:
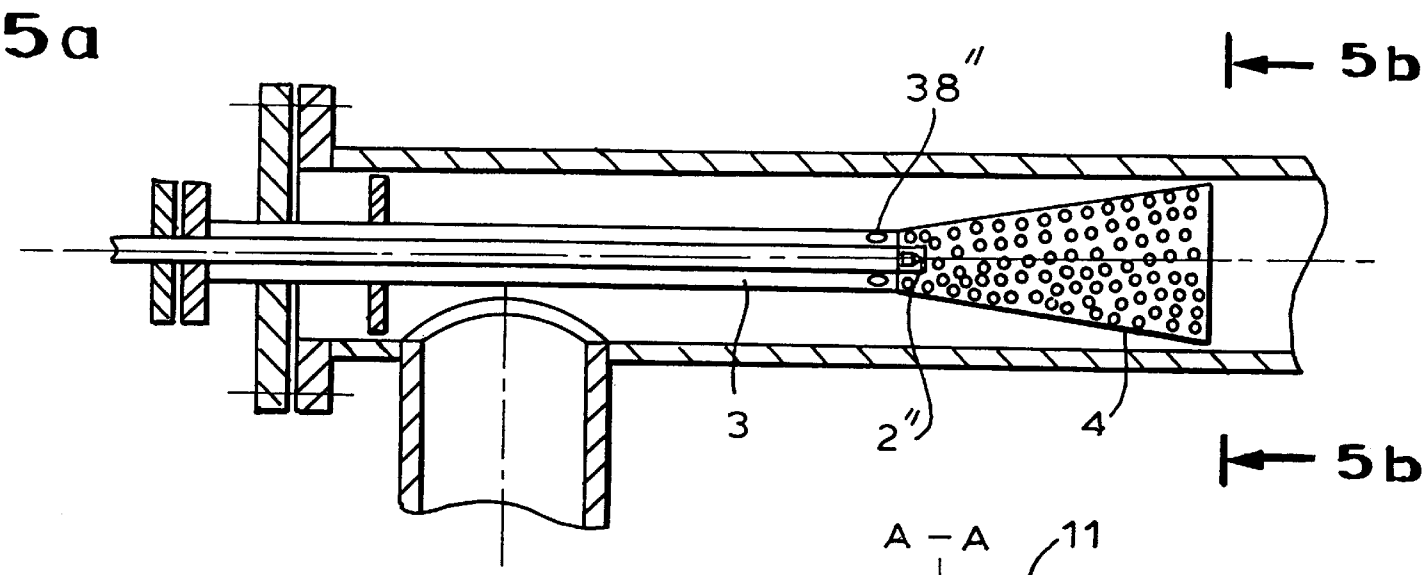
FIG. 5*a* is a diagrammatic view of another embodiment of injection apparatus incorporating a flow detector similar to that of FIG. 4*a* with some modifications and a multi-nozzle arrangement.
Figure 5B:
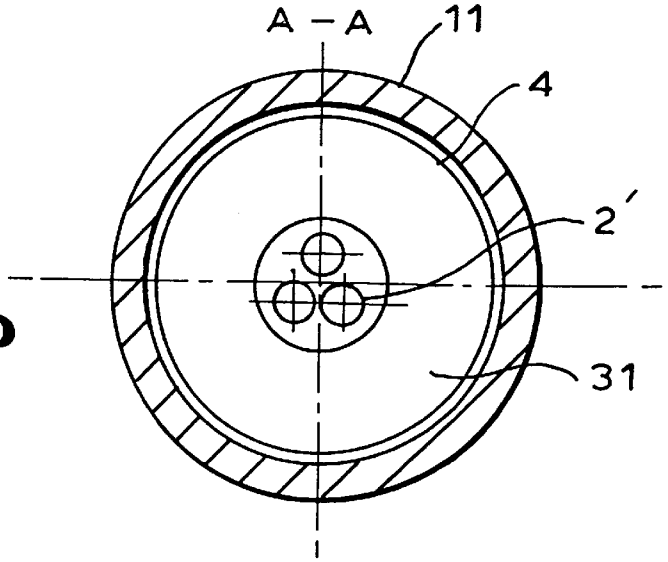
FIG. 5*b* is a transverse cross-sectional view taken along line 5*b*—5*b* of FIG. 5*a* showing the multi-nozzle, viewed in an upstream direction.

The embodiment shown in FIG. 5*a* and FIG. 5*b* is closely similar to that of FIG. 4*a* and FIG. 4*b*, except that a multi nozzle arrangement of three nozzles 2" is provided and a plurality of lateral process gas admitting apertures 38" are also provided in the tube 3, upstream of the nozzle 2". This enables a larger throughput with smaller nozzle orifice size, reducing drop size and vaporizing time, therefore enabling a reduction in the length of the deflector.

Figure 6A:
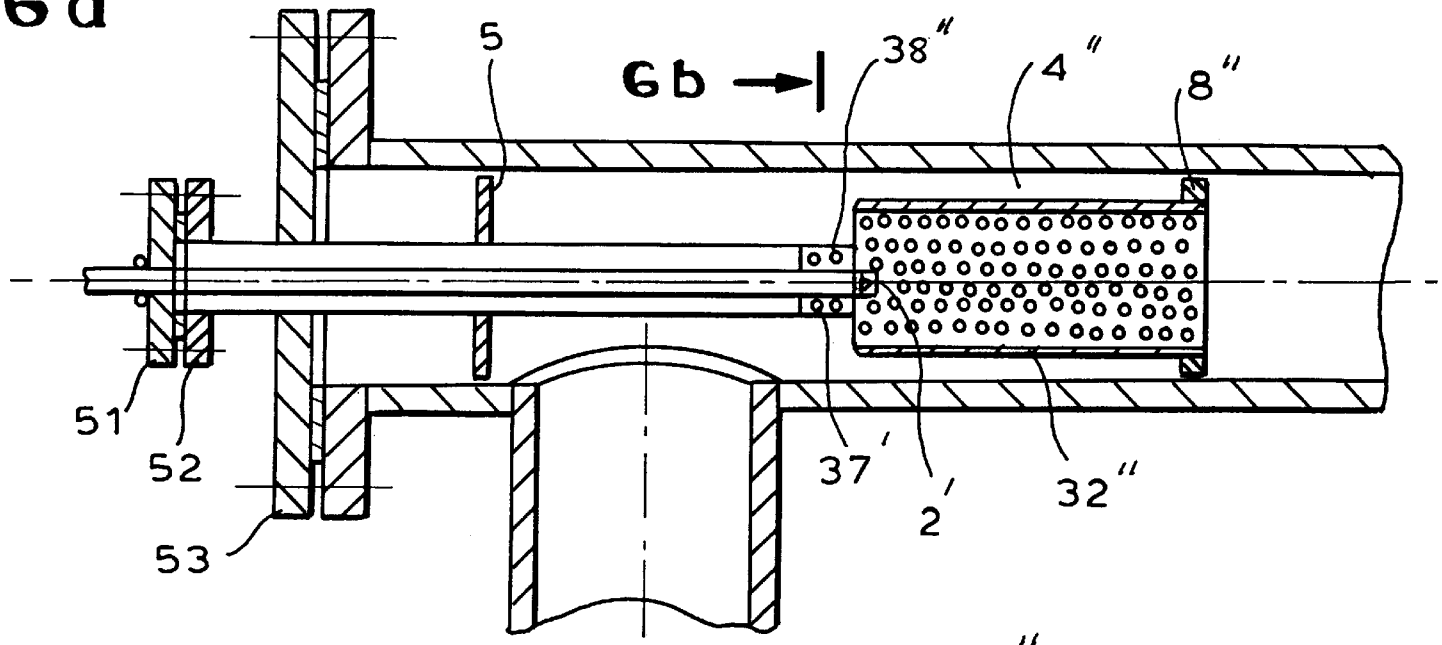
FIG. 6*a* is a diagrammatic view of a further embodiment of injection apparatus incorporating another flow detector.
Figure 6A:
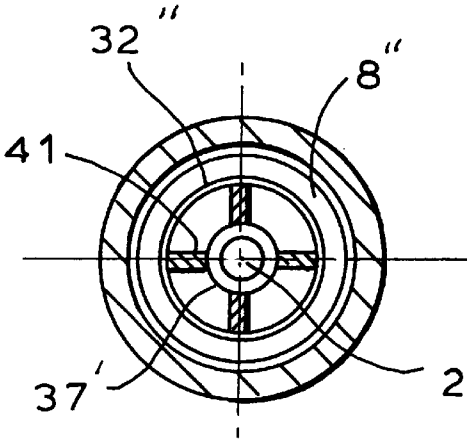

In the embodiment shown in FIG. 6*a* and FIG. 6*b*, the deflector 4" has a perforated, open-ended cylindrical wall portion 32" of larger diameter than the nozzle and which terminates at a downstream end in an imperforate, radially extending flange 8" which bridges between the wall portion and the internal surface of the tube, assuring that substantially all process gas flows through the deflector. The wall portion 32" is secured at an upstream end to a perforated tubular wall portion 37' by four equiangularly located, radially extending axial fins As in previously described embodiments, the perforations provide lateral apertures 38" so that the process gas enters the mixing and vaporizing zone within the deflector through the apertures 38" at 90 degrees and through open ends at 0 degrees relative to the axis.

The axial position of the liquid conveying tube 1 and nozzle relative to tube 3 and deflector 4 can be adjusted. Tube 1 is welded to handle 51 and tube 3 is welded to handle 52 and flange 53. Release of bolts securing handles 51 and 52 permits axial adjustment of tube 1 and nozzle 2, while release of bolts securing flange 53 to the tube port enables axial adjustment of tube 3 and deflector 4.

Preliminary industrial plant test data, (not described herein in detail), indicate that use of the apparatus (FIGS. 1,2,3,4,5 and 6) for injecting solution into a thermal naphtha stream cracking furnace results in reducing the coke formation and carbon oxides, removing coke deposits and consequently increasing operation time between shutdowns. It is, therefore, concluded that this apparatus is suitable for catalytic pyrolysis during thermal cracking of any hydrocarbons. Actually, the particle sizes, formed by evaporation of spray in the flow deflector is about 0.2–40.0 microns, and the catalytic surface is formed in the conical flow deflector, at a rate of about 166,734.0 meters/second. This increased yields of the desirable lower olefins by about 2–10 wt. %. The numbers of particles can be increased significantly by reducing the diameter of the nozzle orifice or by increasing the input pressure of the liquid solution to the nozzle.

What I claim is:

1. An apparatus for injecting a liquid solution into a hot gaseous process stream in a thermal cracking furnace tube for inhibiting the formation of coke, for removing coke deposits and for providing catalytic pyrolysis, so that the liquid solution does not contact the furnace tube/coil, comprising:

(a) an inner liquid solution supply tube having one end for connection to a pressurized supply of liquid solution and another end extending through an access port along the furnace tube;

(b) a centrifugal, atomizing nozzle having an inlet mounted to another end of the supply tube, and a nozzle outlet for discharging the liquid solution as a spray of small drops;

(c) an outer tube extending in concentric, insulating relation along the liquid solution supply tube between the access port and the nozzle;

(d) a flow deflector comprising an apertured peripheral wall having a portion defining a tubular mixing and vaporizing chamber extending coaxially along the furnace tube and having an axial inlet end mounted in registration with the nozzle outlet to receive all spray therefrom and an axial outlet end which is radially enlarged so as to deflect the gaseous process stream through wall apertures into the chamber thereby dispersing and vaporizing all drops of liquid solution within the chamber without the liquid solution contacting the peripheral wall and the furnace tube so that only particulate material is entrained in the gas process stream leaving the outlet end for dispersal downstream throughout a radiation stage of the furnace.

2. An apparatus according to claim 1, wherein the drops dispersed by the nozzle are about 0.2–40 microns in diameter.

3. An apparatus according to claim 2, wherein the angle subtended by the spray at the nozzle outlet is about 5–30 degrees.

4. An apparatus according to claim 1, wherein a disk-form baffle is mounted concentrically on the outer tube adjacent the access port thereby preventing access of hot process gas thereto.

5. An apparatus according to claim 1, wherein the peripheral wall portion defines a cylindrical chamber of larger diameter than the nozzle and the radially enlarged axial outlet end comprises an imperforate, radially extending flange which bridges between the cylindrical chamber and the furnace tube assuring that substantially all process gas flows through the chamber.

6. An apparatus according to claim 5, wherein the peripheral wall portion is secured at an upstream end to a further apertured tubular wall portion of reduced diameter, concentric with the supply tube, by equiangularly located, radially extending axial fins.

7. An apparatus according to claim 1 wherein the chamber is of conical shape with a base thereof forming the radially enlarged end.

8. An apparatus according to claim 7 wherein the wall portion defining the conical shape comprises a series of axially displaced, hollow cylindrical portions having progressively increased diameters in a downstream direction and means are provided for mounting said hollow cylindrical portions in axially displaced, coaxial relation.

9. An apparatus according to claim 8 wherein the mounting means comprise a series of elongate, axially extending fins joining respective outer circumferential wall portions of respective cylindrical portions.

10. An apparatus according to claim 7, wherein the wall portion defining the conical shape is continuously divergent.

11. An apparatus according to claim 1, wherein the ratio between total cross-sectional area of wall apertures and the cross- sectional area of the furnace tube is about 0.8–3.0.

12. An apparatus in accordance with claim 7, wherein said flow deflector has an axial length of about 300–600 millimeters.

13. An apparatus according to claim 1 wherein the furnace tube is located in the convection zone of a cracking furnace where the gaseous process stream is at a temperature of about 300–650 degrees centigrade.

14. An apparatus according to claim 13 wherein the liquid solution flowed through said nozzle at a rate of up to 300 liters per hour.

15. An apparatus according to claim 14 wherein the nozzle produces a pressure drop of at least 7 atmospheres.

16. An apparatus according to claim 15 wherein the gaseous process stream is flowed through the chamber at a rate of about 15–30 Kg/m s sec.

17. An apparatus for injecting a liquid solution into a hot gaseous process stream in a thermal cracking furnace tube for inhibiting the formation of coke, for removing coke deposits and for providing catalytic pyrolysis, so that the liquid solution does not contact the furnace tube/coil, comprising:

a centrifugal, atomizing nozzle having an inlet for receiving a coke inhibiting solution as a continuous, pressurized stream and a nozzle outlet for discharging the solution as a spray of small drops;

a gaseous process stream deflector extending across the furnace tube and having a tubular wall portion providing a mixing and vaporizing chamber having an axial inlet end in registration with the nozzle outlet for receiving all spray therefrom and an axial outlet end downstream, the wall portion being formed with lateral apertures for admitting deflected gas stream into the chamber with both axial and transverse components of velocity so as to disperse and vaporize the drops entirely within the chamber without the solution contacting the tubular wall portion of the deflector and the surrounding furnace tube so that only particulate material is entrained in the deflected gaseous process stream leaving the outlet end and dispersed downstream throughout a radiation stage of the furnace.

18. An apparatus for injecting a liquid solution into a hot gaseous process stream in a thermal cracking furnace tube for inhibiting the formation of coke, for removing coke deposits and for providing catalytic pyrolysis, so that the liquid solution does not contact the furnace tube, comprising:

an atomizing nozzle for mounting in a furnace tube having an inlet for connection to a supply of the liquid solution under pressure and an outlet for discharging the liquid solution as a spray jet of small drops into a hot gaseous process stream at an axially central location of the furnace tube; and deflector means for mounting in the hot gaseous process stream in the furnace tube in registration with the outlet of the nozzle to deflect outer portions of the process gas stream radially inward providing a draught of deflected hot process gas surrounding and converging on the spray jet, thereby confining the spray jet axially central of the furnace tube away from the deflector means and walls of the furnace tube while mixing with and vaporizing the drops so that the drops do not contact either the deflector means or walls of the furnace tube.

19. An apparatus according to claim 18 wherein the deflector is an elongate tube for mounting with a tube axis thereof extending coaxial with a furnace tube axis so that the draft of deflected hot process gas surrounds and converges on the spray jet for subtantially an entire axial length of the deflector.

* * * * *